US008701215B2

(12) United States Patent
Levine

(10) Patent No.: US 8,701,215 B2
(45) Date of Patent: Apr. 22, 2014

(54) MEDICAL GOWN

(76) Inventor: Ian Levine, Cote St Luc (CA)

( * ) Notice: Subject to any disclaimer, the term of this patent is extended or adjusted under 35 U.S.C. 154(b) by 0 days.

(21) Appl. No.: 13/366,751

(22) Filed: Feb. 6, 2012

(65) Prior Publication Data

US 2013/0198930 A1 Aug. 8, 2013

(51) Int. Cl.
*A41B 9/00* (2006.01)

(52) U.S. Cl.
USPC ..... 2/114

(58) Field of Classification Search
USPC ..... 2/114, 115, 108, 69, 69.5, 78.3, 243.1; 482/121, 124
See application file for complete search history.

(56) References Cited

U.S. PATENT DOCUMENTS

| | | | | |
|---|---|---|---|---|
| 4,434,511 | A * | 3/1984 | Weiser | 2/114 |
| 7,971,274 | B2 * | 7/2011 | Graneto, III | 2/114 |
| 8,375,468 | B2 * | 2/2013 | Okamoto et al. | 2/69 |
| 2001/0034891 | A1 | 11/2001 | Matsushita | |
| 2009/0031464 | A1 | 2/2009 | Luc Gorby | |
| 2010/0031419 | A1 | 2/2010 | Halseth | |

FOREIGN PATENT DOCUMENTS

| | | | |
|---|---|---|---|
| CN | 2010 48572 | Y | 4/2008 |
| JP | 2004 238773 | A | 8/2004 |
| JP | 2005 3508820 | A | 12/2005 |
| JP | 2007 332515 | A | 12/2007 |
| WO | 2010033493 | A2 | 3/2010 |
| WO | 2012071007 | A1 | 5/2012 |

OTHER PUBLICATIONS

Design U.S. Appl. No. 29/410,453, Ian Levine.
European Search Report for Application No. EP 13 15 0713—date of completed search Apr. 24, 2013.
Hong Kong Short Term Patent Application No. 13100312.6 (Hong Kong Patent No. HK1173319).

* cited by examiner

*Primary Examiner* — Tejash Patel
(74) *Attorney, Agent, or Firm* — Donald J. Ranft; Collen IP

(57) ABSTRACT

A body covering gown which is secured on the user by one or more stretchable strips which extend across an opening in the gown.

18 Claims, 2 Drawing Sheets

MEDICAL GOWN

BACKGROUND

Many types of gowns used in medical procedures by patients, visitors, and medical personnel exist. Both disposable and reusable gowns are utilized. It is important that they can easily be put on and secured by the user. Securing the gown so that it does not fall off is critical. Various means are used such as ties, buttons, hooks and loops, and snaps. All require additional action by the user or another person.

SUMMARY

Elastic strips are included on the gown to allow placement over the head of the user with no action needed to ensure the gown will not fall off the user.

DETAILED DESCRIPTION

Figure 2:
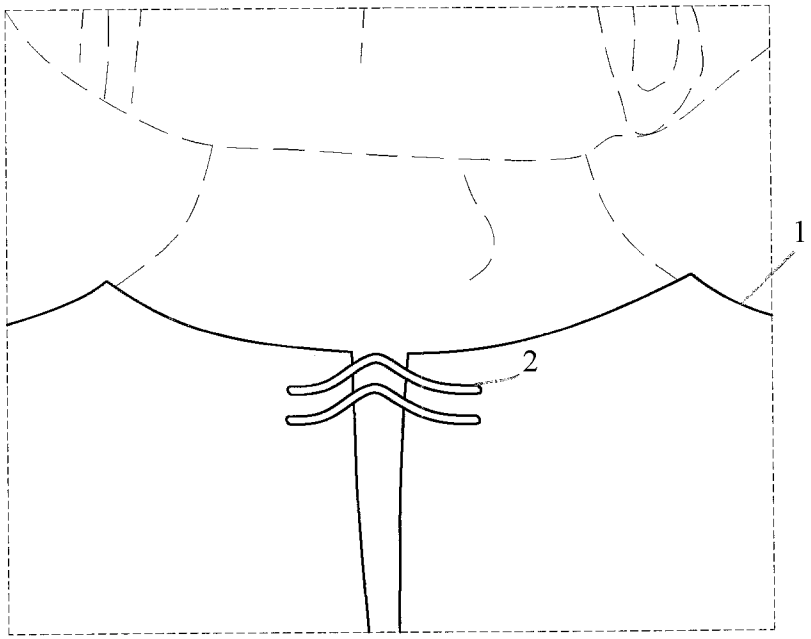
FIG. 2 depicts a partial view of a section of FIG. 1.

The described embodiment shown on the figures is a gown (1) with one or more elastic strips (2). Typically the gown has an opening from its top area which is intended to lay on the user's shoulders to its bottom area. One end of each elastic/stretchable strip (2) is secured to one side (3) of the opening in the back of the gown (1) with the second end of the strip (2) attached to the other side (4) of the opening in the gown (1). At least one elastic strip is typically located on the upper portion of the gown near the top area of the gown as shown on FIG. 1. As shown on FIG. 1, the gown extends from the shoulder to at least the thigh area of the user. The flexible strip(s) are positioned to be in the neck/shoulder area of the user to prevent the gown from falling off the user and also allows for the gown to stretch and adjust to the movements and requirements of users of different sizes. The material of the gown can be varied as warranted by the intended use and the intended user. Thus the gown can be disposable or reusable.

Figure 1:
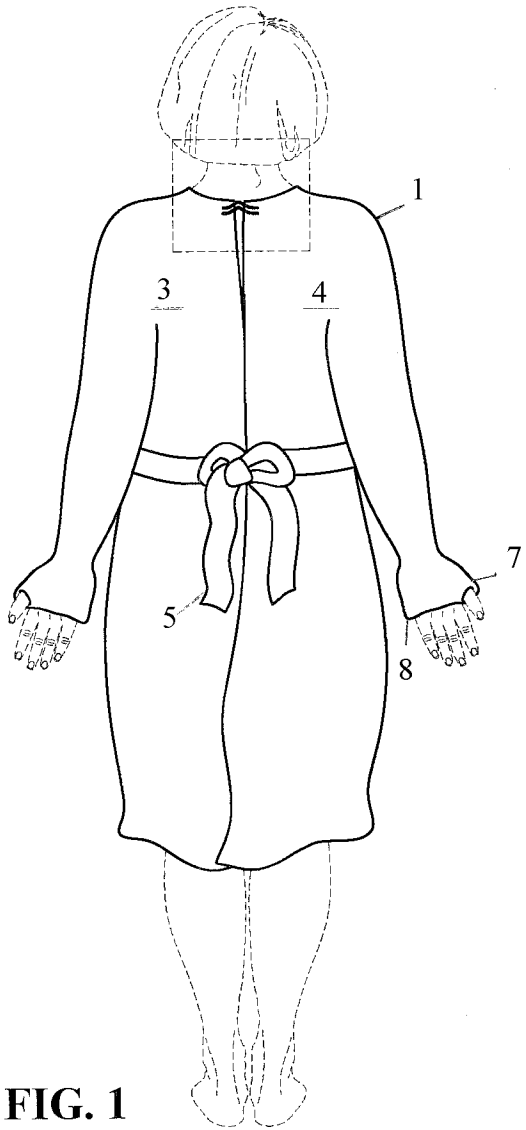
FIG. 1 depicts the back of a patient wearing a gown.

The gown can include sleeves and openings for the user's hands as shown on FIG. 1. The separate openings for the thumb (7) and other fingers (8) provide an additional means to secure the gown to the user. This is especially important when the user is for example a surgeon.

Numerous embodiments are envisioned by this invention. The number, dimensions and locations of the elastic strips can be changed as warranted for an intended user of the gown.

Figure 3:
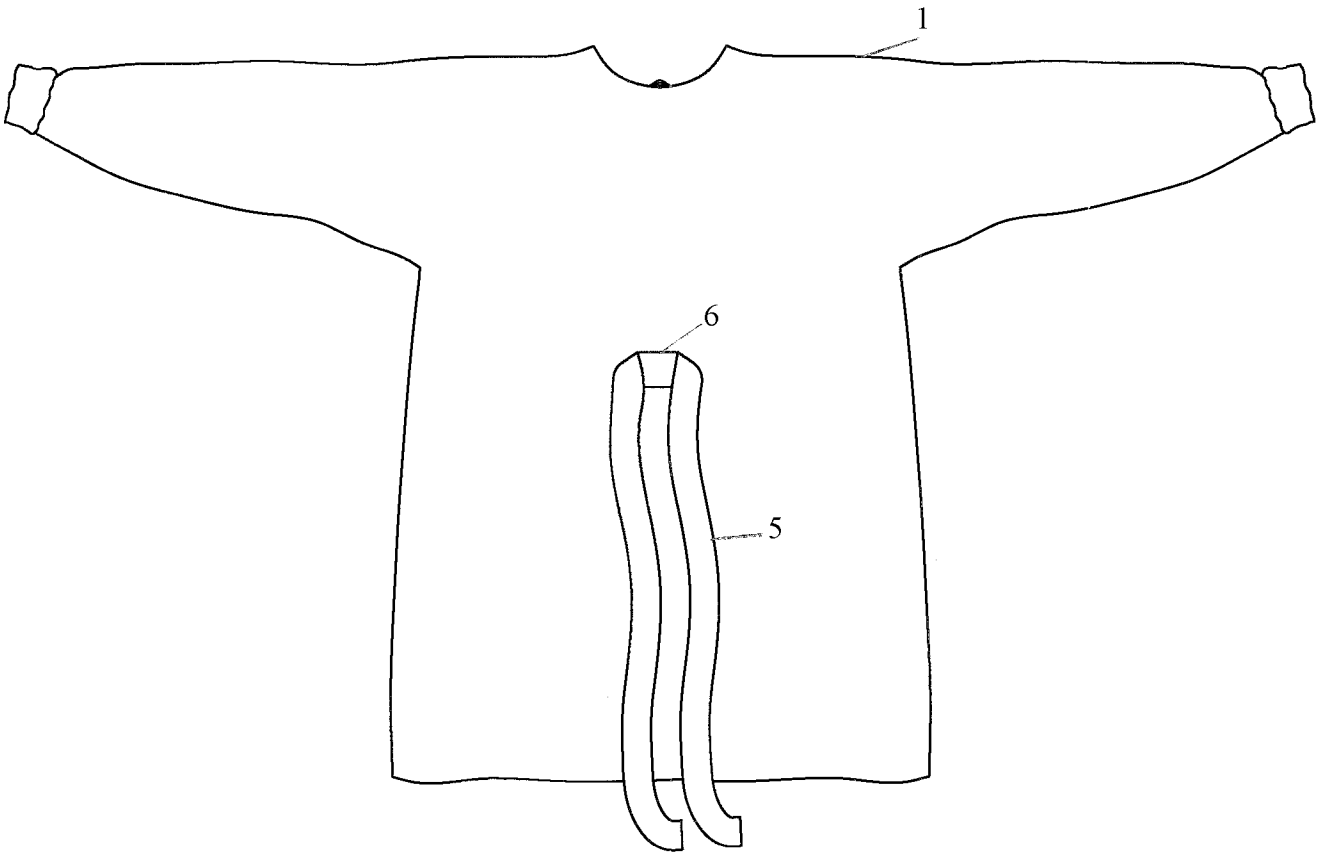
FIG. 3 depicts a front view of one embodiment of the gown.

An additional means to further secure the gown may be included as warranted. FIGS. 1 and 3 show one such means. FIGS. 1 and 3 show a strap (5) secured to the front (6) which is long enough to surround the gown and tied in the back. One or more loops as used for belts on pants can be located on the gown as desired to hold the strap in place. The length of the strap and means to secure it to the gown can be varied as desired to allow closure in the front, side or rear of the gown.

In other embodiments, the location and number of openings in the gown are varied. And in other embodiments, the strap is replaced by other means to further secure the gown. These include the use of hook and loop, pressure sensitive adhesive strips, or snaps attached to each side of the opening in the gown and located as warranted.

All of these embodiments can be incorporated into disposable or reusable gowns. I also include gown used in other applications besides medical such as food preparation, chemical testing and industrial clean rooms.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

The invention claimed is:

1. A gown comprising:

a body covering portion with at least one opening in the back area having top and bottom edges; and at least two elastic strip with two ends extending across the back opening, and the two ends attached opposite each other on each side of the back opening in the neck area on the gown the at least two elastic strips are spaced apart and parallel relative to the top and bottom edges of the gown.

2. A gown according to claim 1 further comprising at least one additional means to secure the gown after placement on a user.

3. A gown according to claim 2 in which a strap is used to further secure the gown after placement on the user.

4. A gown according to claim 2 in which the additional means to secure the gown is a hook and loop design is attached in at least one appropriate location on the gown.

5. A gown according to claim 1 further comprising sleeves in which the sleeves extend out from the body covering portion down to each hand and include separate openings for the thumb and for the other fingers.

6. A gown according to claim 1 in which the gown is disposable.

7. A gown according to claim 2 in which the gown is designed to be reusable.

8. A gown comprising:

a body covering portion with at least one opening;

at least one opening extending from the gown's top area to the lower edge of the gown; and at least one elastic strip with two ends extending across the opening, and the two ends attached opposite each other on each side of the opening in the neck area of the gown.

9. A gown according to claim 8 further comprising sleeves in which the sleeves extend from the body covering portion of the gown to each hand and include separate openings for a user's thumb and for the user's other fingers.

10. A gown according to claim 8 further comprising at least one additional means to secure the gown after placement on a user.

11. A gown according to claim 10 in which a strap is used to further secure the gown after placement on the user.

12. A gown according to claim 10 in which the additional means to secure the gown is a hook and loop design is attached in at least one appropriate location on the gown.

13. A gown according to claim 1 in which the gown is designed to extend from a shoulder area of a user to at least a thigh area of the user.

14. A gown comprising:

a body covering portion with at least one opening in the back are having top and bottom edges; and at least two elastic strip with two ends extending across the back opening; and the two ends attached opposite each other on each side of the back opening in the neck area on the gown; the at least two elastic strips are spaced apart and parallel relative to the top and bottom edges of the gown wherein the body covering portion includes sleeves.

15. A gown according to claim 14 in which the sleeves extend from the body covering portion of the gown to each hand and include separate opening for a user's thumb and other fingers.

16. A gown according to claim 14 further comprising at least one additional means to secure the gown after placement on the user.

17. A gown according to claim 16 in which a strap is used to further secure the gown after placement on the user.

18. A gown according to claim 16 in which the additional means to secure the gown is a hook and loop fastener.

* * * * *